US012138518B1

(12) United States Patent
Gilman

(10) Patent No.: US 12,138,518 B1
(45) Date of Patent: Nov. 12, 2024

(54) TACKLING TRAINING DEVICES AND METHODS

(71) Applicant: Marty Gilman, Inc., Gilman, CT (US)

(72) Inventor: Neil F. Gilman, Gilman, CT (US)

(73) Assignee: Marty Gilman, Inc., Gilman, CT (US)

( * ) Notice: Subject to any disclaimer, the term of this patent is extended or adjusted under 35 U.S.C. 154(b) by 0 days.

(21) Appl. No.: 18/620,889

(22) Filed: Mar. 28, 2024

Related U.S. Application Data

(63) Continuation-in-part of application No. 29/922,903, filed on Dec. 26, 2023, now Pat. No. Des. 1,044,990.

(51) Int. Cl.
*A63B 69/34* (2006.01)
*A63B 71/06* (2006.01)

(52) U.S. Cl.
CPC ..... *A63B 69/34* (2013.01); *A63B 2071/0694* (2013.01); *A63B 2210/50* (2013.01); *A63B 2214/00* (2020.08); *A63B 2243/007* (2013.01)

(58) Field of Classification Search
CPC ..... A63B 69/34; A63B 2071/0694; A63B 2210/50; A63B 2214/00; A63B 2243/007
USPC ..... 473/422, 438–445
See application file for complete search history.

(56) References Cited

U.S. PATENT DOCUMENTS

| | | | | |
|---|---|---|---|---|
| 3,384,372 | A * | 5/1968 | Dickens | A63B 69/34 273/DIG. 8 |
| 3,396,969 | A * | 8/1968 | Rosenfeld | A63B 69/34 473/444 |
| 5,280,905 | A * | 1/1994 | Micco | A63B 69/34 482/84 |
| 8,147,357 | B1 * | 4/2012 | Nichols | A63B 69/0002 473/453 |
| 9,393,476 | B2 * | 7/2016 | Arena | A63B 69/34 |
| 9,550,102 | B1 * | 1/2017 | George | G09B 19/0038 |
| 9,814,959 | B1 * | 11/2017 | Riera | A63B 69/24 |
| 11,369,853 | B1 * | 6/2022 | Tarlini | A63B 69/34 |
| 2007/0167297 | A1 * | 7/2007 | Stevenson | A63B 71/023 482/90 |

FOREIGN PATENT DOCUMENTS

FR 3118887 A1 7/2022

* cited by examiner

*Primary Examiner* — Nini F Legesse
(74) *Attorney, Agent, or Firm* — DeWitt LLP; Brian R. Pollack, Esq.

(57) ABSTRACT

The disclosure provides embodiments of tackling devices and methods of use thereof that are useful for training safer techniques of tackling.

18 Claims, 17 Drawing Sheets

TACKLING TRAINING DEVICES AND METHODS

CROSS-REFERENCE TO RELATED APPLICATIONS

The present patent application is a continuation-in-part of and claims the benefit of priority to U.S. Design patent application Ser. No. 29/922,903, filed Dec. 26, 2023. The foregoing patent application is hereby incorporated by reference in its entirety for all purposes.

FIELD OF THE DISCLOSURE

The present disclosure relates to athletic equipment, particularly training equipment for teaching tackling techniques.

BACKGROUND OF THE DISCLOSURE

In the game of football today, there is a huge effort to reduce and minimize the occurrence of concussions. One way to accomplish that goal is to change the techniques of tackling. Historically, a defender made a tackle by targeting the ball carriers chest with his helmet or stopping the ball carriers movement by placing his helmet "across the bow" of the ball carrier. In either case, the person doing the tackling sustained a violent blow to the head increasing the chances of sustaining a head or neck injury including a concussion. The present disclosure provides equipment and techniques to address the deficiencies in the state of the art.

SUMMARY OF THE DISCLOSURE

The disclosure provides embodiments of a tackling training device and associated methods. In some implementations, a tackling training device is provided that includes a frame, wherein the frame includes a plurality of outwardly extending projections coupled at a central origin, and a plurality of pads. Each pad of the plurality of pads can be coupled to and surround at least a portion of each said projection in the plurality of projections of the frame.

In some implementations, the frame can include four outwardly extending projections configured in a tetrahedral arrangement, wherein a free end of each said outwardly extending projection can define an apex of a tetrahedron in three-dimensional space. In some implementations, the frame can be made from a plurality of discrete components. For example, in some embodiments, the frame can include a central hub removably attached to each said outwardly extending projection. Each said outwardly extending projection is removably attached to the hub in a structurally overlapping relationship. In other implementations, each outwardly extending projection can be attached to an adjacent projection by a coupling. If desired, each said outwardly extending projection can be removably attached to the hub by at least one of a threaded connection, an overlapping interference fit, and a spring-loaded coupling, among others.

In some implementations, the hub can include a plurality of outwardly extending stubs connected at a central point. For example, each outwardly extending stub can be between about five and twenty-five percent of a length of each outwardly extending projection. In accordance with further implementations, the hub can define a plurality of elongate passages therein, wherein each elongate passage being configured to receive a respective outwardly extending projection therein.

In accordance with further implementations, the tackling training device can further include comprising a coupling to attach each pad in the plurality of pads to each said projection in the plurality of projections of the frame. The coupling can be configured to removably or non-removably attach each said pad in the plurality of pads to each said projection in the plurality of projections of the frame. For example, the coupling can include at least one of an adhesive material, a strap, a threaded fastener, a tie, and a clip, among others. In some implementations, the frame of the tackling training device can be formed at least in part from a rigid material, or a flexible material. For example, a flexible material can facilitate compression and shipment of the frame.

In further accordance with the disclosure, each said pad of the plurality of pads can be formed from a padding material surrounded by a fabric layer. Each said pad of the plurality of pads can have a cross sectional shape selected from a circle, an ellipse, and a polygon. In some implementations, each said pad of the plurality of pads can include an external contour having at least one raised surface extending from the external contour forming a gripping surface to be gripped by a user. If desired, the at least one raised surface can have a shape resembling a portion of an opposing player. The at least one raised surface can have a shape resembling shoulder pads of an opposing player, or another portion of an opposing player, such as a waist section, a leg, an arm, or the like. If desired, the at least one raised surface can include a visual indicia distinct from the at least one raised surface to provide a visual target for a user of the device to aim for when practicing a tackle.

In some implementations, tackling training devices in accordance with the present disclosure can be placed into a disassembled state to facilitate storage and shipment. For example, the disclosure provides illustrative methods of providing a tackling training device, including disposing the plurality of outwardly extending projections, hub and plurality of pads in a container, and shipping the container. Methods of assembling a tackling training device are provided in accordance with the disclosure including opening the container, coupling the plurality of outwardly extending projections to the hub to form the frame, and attaching the plurality of pads to the frame. If desired, attaching the plurality of pads to the frame can include sliding each pad in the plurality of pads over a respective outwardly extending projection and coupling each respective pad to the frame using a fastener. The fastener can include a strap that a user directs over a portion of the frame to hold the pad in place.

The disclosure further provides implementations of performing a tackling drill including providing a device according to claim 1 and running and tackling the device by gripping at least one of the pads and pushing the device forward. In some implementations, the gripping step can include gripping a raised surface extending outwardly from an external contour of one of the pads.

In further accordance with the present disclosure, a tackling training device is provided that includes a frame and a plurality of pads. The frame can include a plurality of outwardly extending projections coupled at a central origin, wherein the frame includes four outwardly extending projections configured in a tetrahedral arrangement, and further wherein a free end of each said outwardly extending projection defines an apex of a tetrahedron in three-dimensional space. The plurality of pads can be coupled to and surround at least a portion of each said projection in the plurality of projections of the frame. The device can further at least one coupling to removably attach each said pad in the plurality of pads to each said projection in the plurality of projections of the frame. The coupling can include a strap attached to each of the plurality of pads at a plurality of locations. Each respective strap can be routed over a portion of the frame geometrically opposed to an outwardly extending projection on which a respective pad is mounted. The strap can be selectively tensioned to hold the pad in place.

In some implementations, the frame can include a hub removably attached to each said outwardly extending projection. Each said outwardly extending projection can be removably attached to the hub in a physically overlapping relationship. The hub and each outwardly extending projection can define a surface with a continuous contour at a location where the hub and each outwardly extending projection meet. Each said outwardly extending projections can be removably attached to the hub by a fastener oriented transversely with respect to an axis defined by each respective outwardly extending projection.

In some implementations, the hub can define a plurality of elongate passages therein. Each elongate passage can be configured to receive at least a portion of a respective outwardly extending projection therein. In some implementations, each said pad of the plurality of pads can be formed from a padding material surrounded by a fabric layer. The fabric layer can include a plurality of layers of fabric located at a free end of each said pad that surround a planar section of resilient material. The plurality of layers can be connected about a periphery thereof to a fabric jacket that surrounds the pad along its length. The fabric layer can further include a ring-shaped layer of fabric disposed at an inward end of the pad. The ring-shaped layer of fabric defining an opening therethrough to receive a respective outwardly extending projection of the frame therethrough.

In some implementations, each said outwardly extending projection of the frame can terminate in a free end having an enlarged cross-sectional area. The free end can have an enlarged cross-sectional area includes an end cap formed from resilient material. Each end cap can be configured to directly contact an inwardly facing surface of one of the layers of fabric located at the free end of each respective pad. Each said pad of the plurality of pads can include an external contour having at least one raised surface extending from the external contour forming a gripping surface to be gripped by a user. The at least one raised surface can have a shape resembling a portion of an opposing player. The at least one raised surface can include a visual indicia distinct from the at least one raised surface to provide a visual target for a user of the device to aim for when practicing a tackle.

In further accordance with the present disclosure, implementations of the tackling training device as described herein can be provided in a disassembled state, inside of a container, for example, to facilitate storage and shipment. Methods of providing implementations of a tackling training device as disclosed herein are provided, including disposing the plurality of outwardly extending projections, hub and plurality of pads in a container, and shipping the container. Methods of assembling a tackling training device as described herein are provided, including, for example, opening a container, coupling a plurality of outwardly extending projections to a hub to form a frame, and attaching a plurality of pads to the frame after the coupling step. Attaching the plurality of pads to the frame can include sliding each pad in the plurality of pads over a respective outwardly extending projection and coupling each respective pad to the frame using a fastener. The fastener can include a strap that a user directs over a portion of the frame to hold the pad in place.

It is to be understood that the foregoing general description and the following detailed description are exemplary and are intended to provide further explanation of the disclosed embodiments. The accompanying drawings, which are incorporated in and constitute part of this specification, are included to illustrate and provide a further understanding of the disclosed methods and systems. Together with the description, the drawings serve to explain principles of the disclosure.

DETAILED DESCRIPTION

Figure 2:
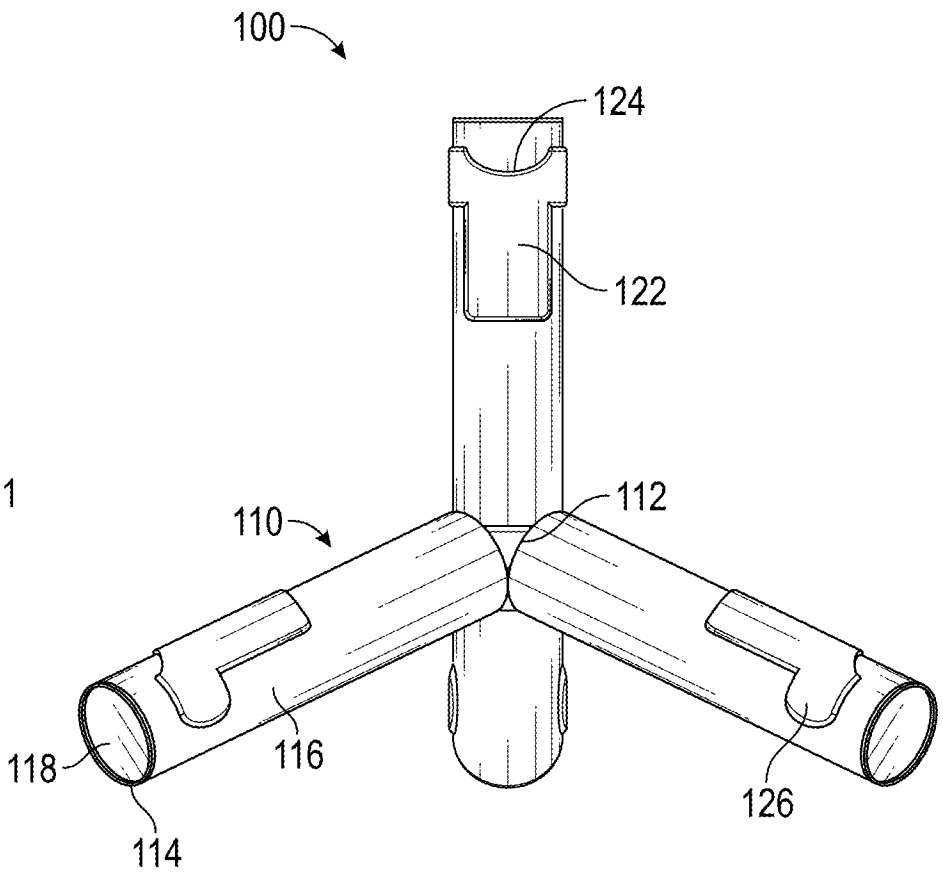
FIG. 2 is a front elevational view of the device of FIG. 1.
Figure 1:
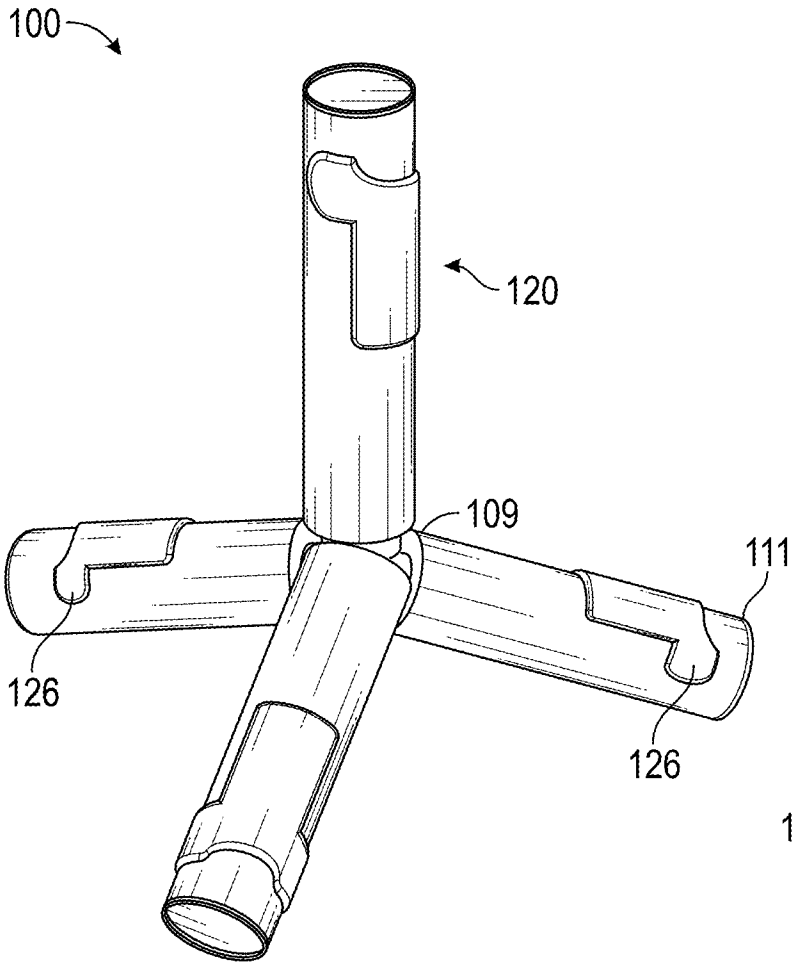
FIG. 1 is an upper isometric view of a tackling training device in accordance with the present disclosure.
Figure 4:
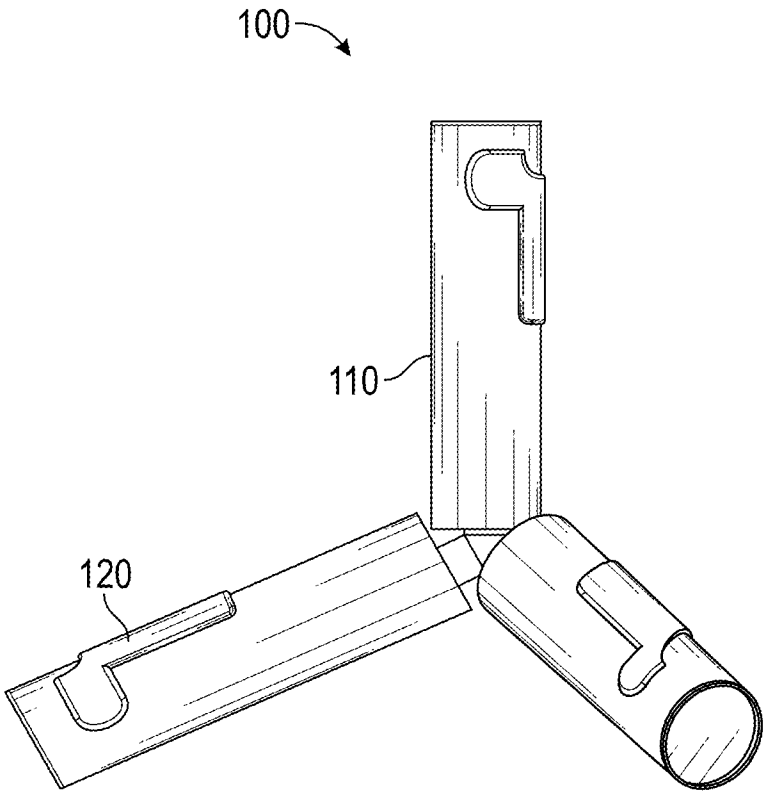
FIG. 4 is a right-side elevational view of the device of FIG. 1.
Figure 3:
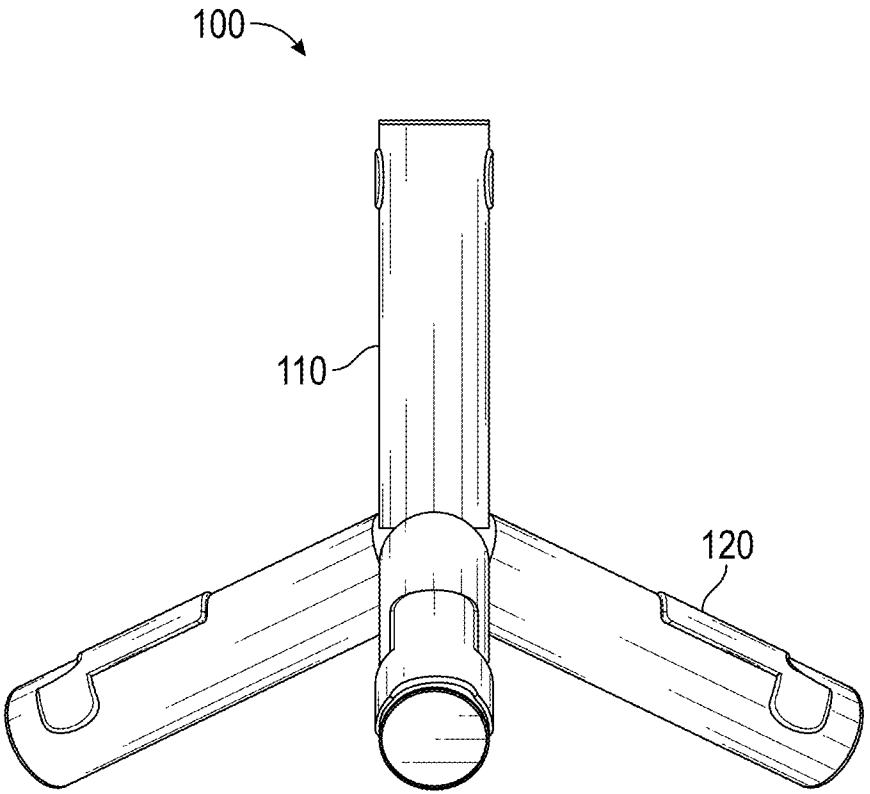
FIG. 3 is a rear elevational view of the device of FIG. 1.
Figure 6:
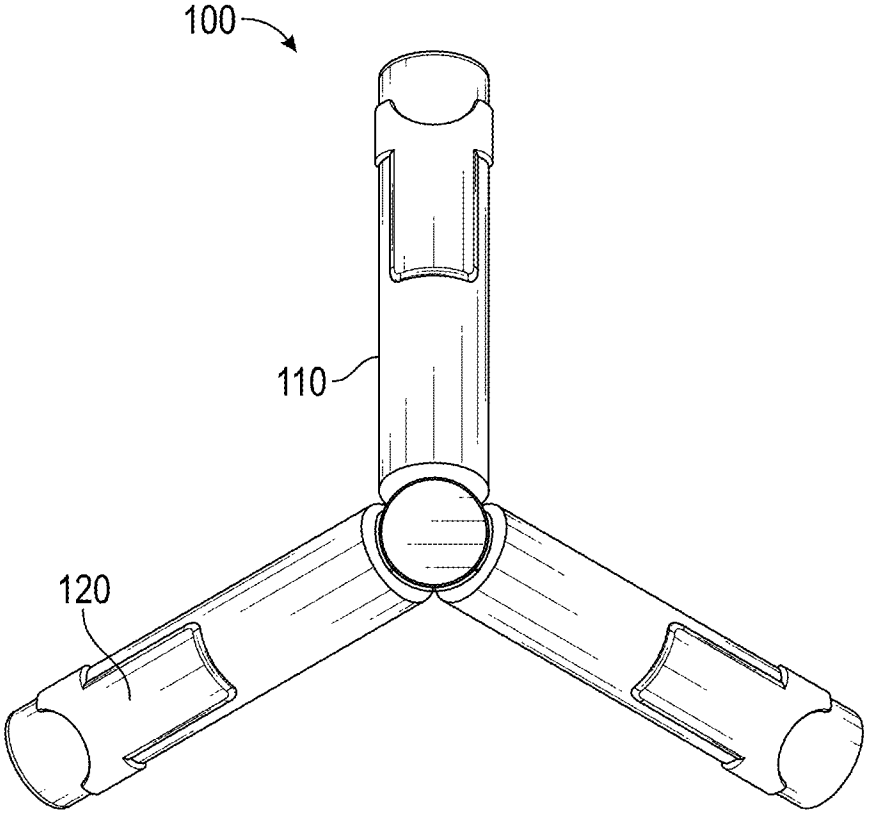
FIG. 6 is a top view of the device of FIG. 1.
Figure 5:
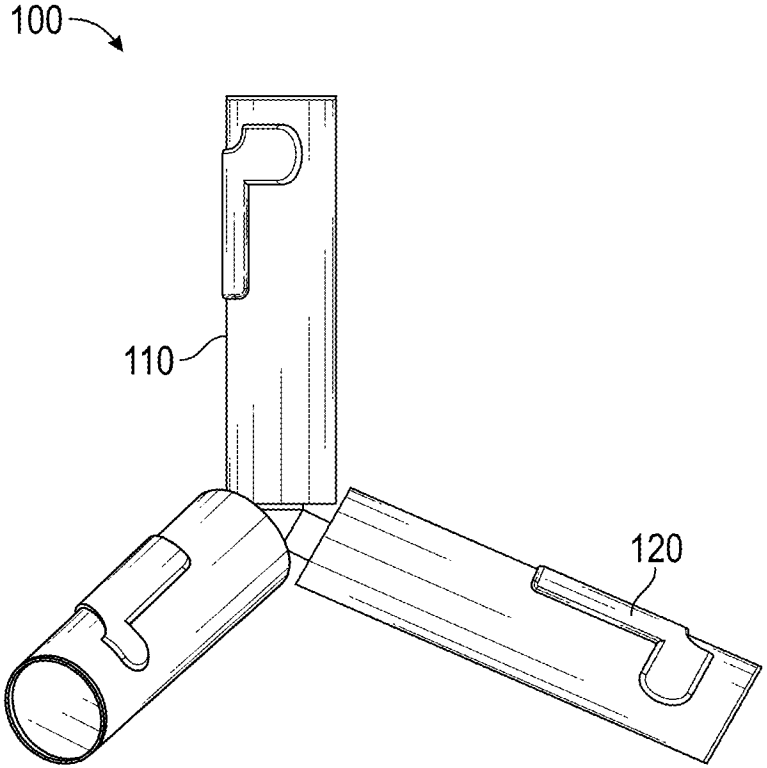
FIG. 5 is a left-side elevational view of the device of FIG. 1.
Figure 7B:
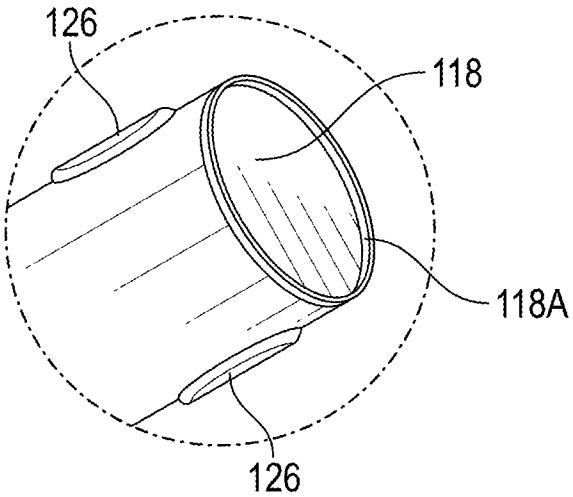
FIG. 7B is an enlarged view of a free end portion of a padded section of the device of FIG. 1.
Figure 7A:
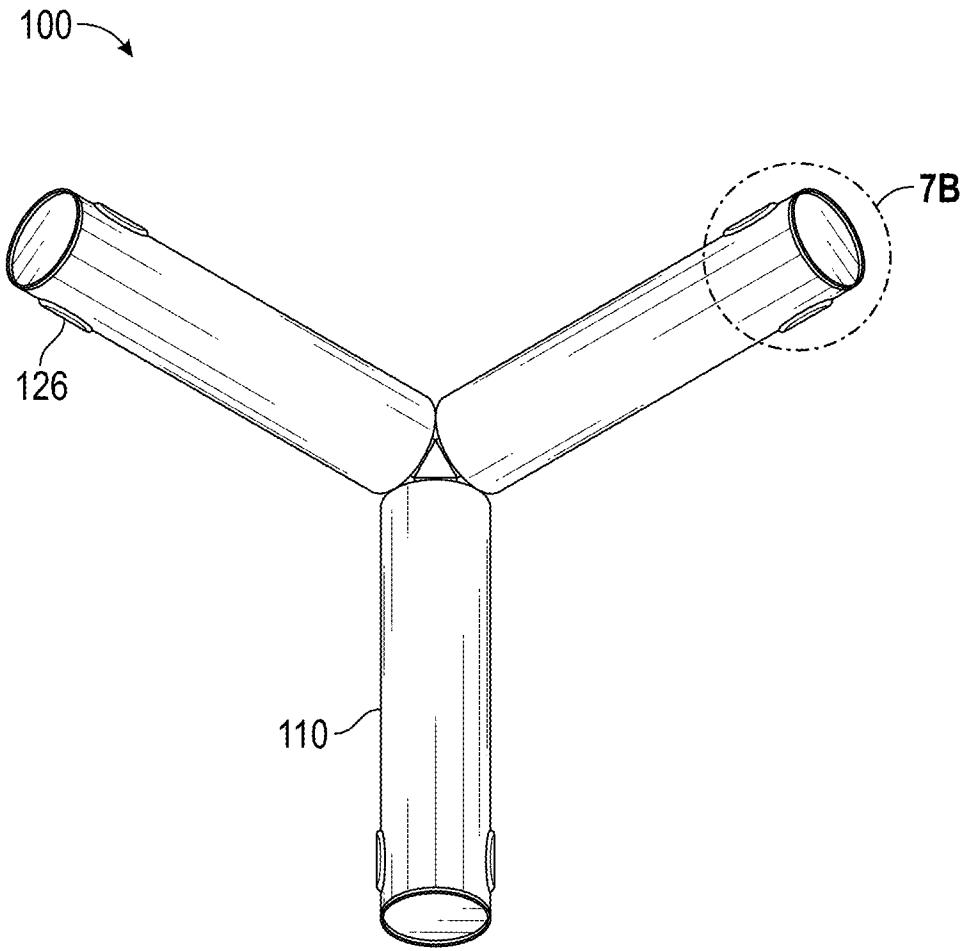
FIG. 7A is a bottom view of the device of FIG. 1.

Description will now be given of the invention with reference to the attached FIGS. 1-27. It should be understood that these figures are exemplary in nature and in no way serve to limit the scope of the invention as the invention will be defined by the claims, as interpreted by the Courts in an issued U.S. Patent.

With reference to FIGS. 1-7B, for purposes of illustration only, and not limitation, a representative implementation of a tackling training device 100 is illustrated, in accordance with the present disclosure. FIGS. 8A-28 illustrate further implementations of such devices, or aspects thereof.

As depicted in the figures, a tackling training device 100 is provided that includes a frame 130 (FIG. 8A), wherein the frame 130 includes a plurality of outwardly extending projections 132 coupled at a central origin C (FIG. 9), and a plurality of pads 110 that are removably attached to the frame projections 132. Each pad can be coupled to and surround at least a portion of each said projection 132.

Figure 8C:
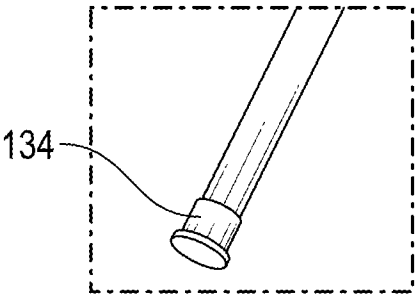
FIG. 8C is an enlarged view of an end portion of a projection of the frame depicted in FIG. 8A.
Figure 8B:
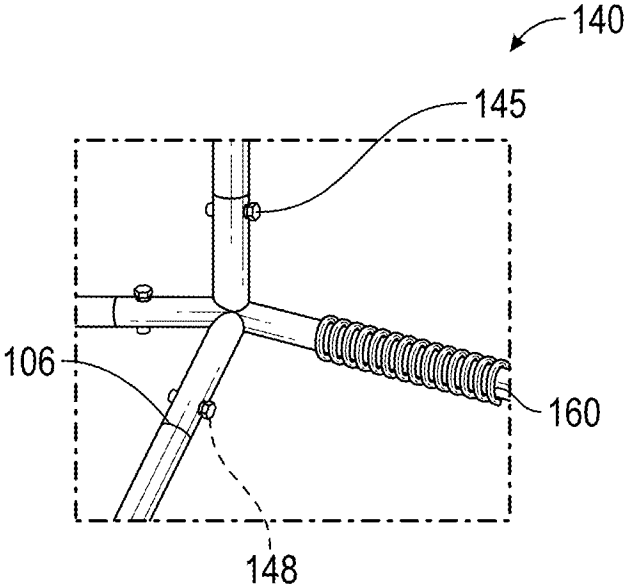
FIG. 8B is an enlarged view of a central portion of the frame depicted in FIG. 8A.
Figure 8A:
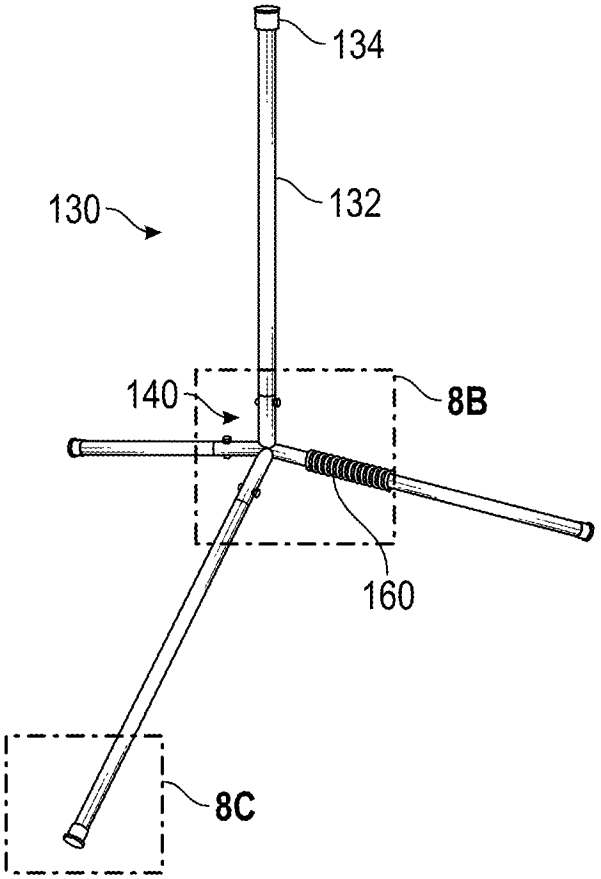
FIG. 8A is an isometric view of an internal frame portion of the device of FIG. 1.
Figure 9:
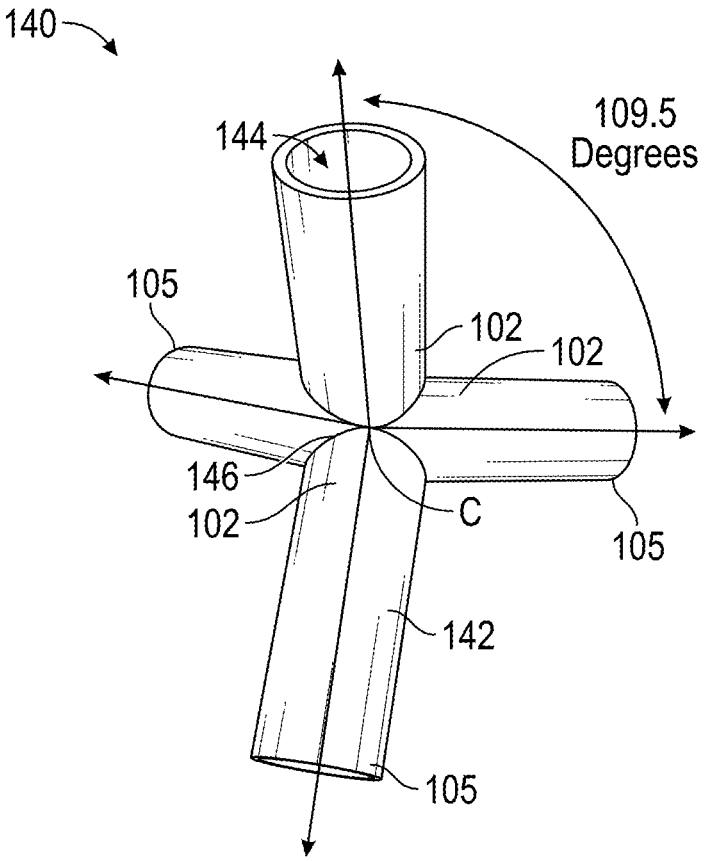
FIG. 9 is an isometric view of a hub portion of the frame depicted in FIG. 8A.

As illustrated, the frame can include four outwardly extending projections 132 configured in a tetrahedral arrangement, wherein a free end of each said outwardly extending projection 132 can define an apex of a tetrahedron in three-dimensional space such that the projections are each separated by about 109.5 degrees. As illustrated, the frame 130 can be made from a plurality of discrete components, or may be unitary. For example, as illustrated in FIGS. 8A-8C, the frame 130 may include a central hub 140 that is removably attached to each said outwardly extending projection 132. The coupling between the hub 140 and the projections 132 preferably provides for a continuous surface along the transition between the two components, as provision of a large flange may be undesirable as it provide an enlarged area that may contact and potentially injure a user. Each outwardly extending projection 132 can terminate in an end portion of a relatively larger diameter such as an end cap 134. End caps 134 can be provided that may fit over the end of each said projection in an interference fit. For example, end caps 134 may be made from a resilient material, such as rubber. This prevents contact between a player and the free end of the projection in the event of a catastrophic failure of the free end of the pad structure. Moreover, the illustrated modular construction can permit ready replacement of system components in the event of damage, or a desire to change the length of the projections 132 or the pads. For example, a pad 110 can be removed from the device without the need for removing the projection. Thus, a kit can be sold with a single frame 130, but pads of different cross-sectional shapes or colors to permit changing out of the pads 110 without the need to change out the projections 132.

Figure 21:
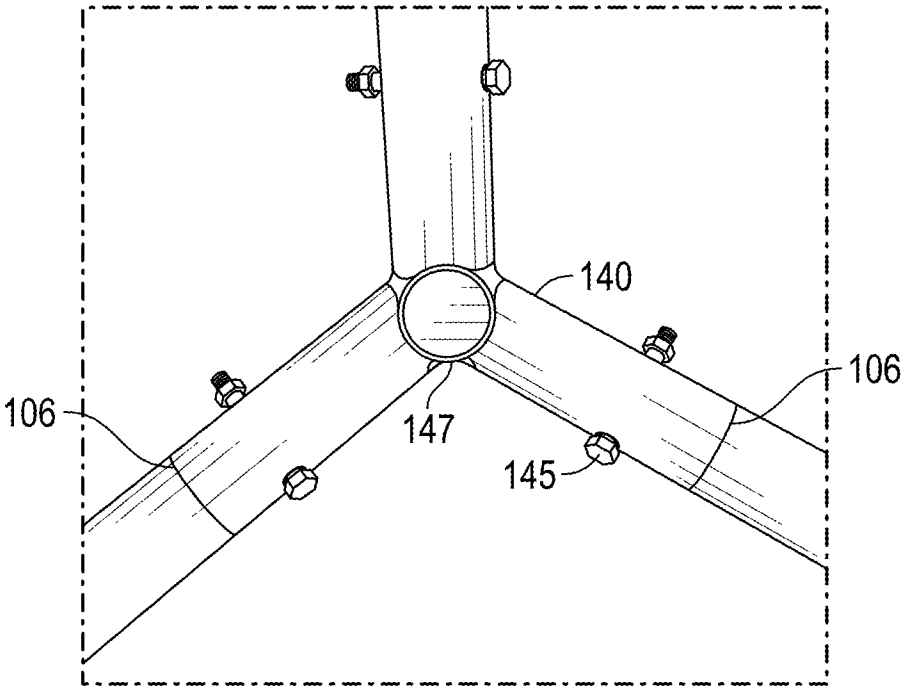

As depicted, hub 140 can include a plurality of outwardly extending stubs or sleeves 142 connected at a central point C by way of a plurality of welds 146, or the hub 140 can be cast or molded as a unitary structure. For example, each outwardly extending stub 142 can be between about five and twenty-five percent of a length of each outwardly extending projection 132, or any increment therebetween of one percent. As illustrated the hub 140 can define a plurality of elongate passages 144 therein, wherein each elongate passage 144 being configured to receive a respective outwardly extending projection 132 therein. The hub 140 can be assembled by welding three individual tubular members to a central tubular member that terminates in a lower opening 147 (FIG. 21).

Each said outwardly extending projection 132 can be removably attached to the hub 140 in a structurally overlapping relationship. In the illustrated implementation, and with reference to FIGS. 9, 15 and 17-20, the projections 132 may each have a first male end 135 that can be received into a corresponding female passageway 144 of the hub 140 in a sliding engagement. Corresponding transverse passageways 148 (FIG. 8B) may be drilled or otherwise formed through the sleeves 142 of the hub and the ends 135 of the projections that may be aligned to receive a fastener 145 therethrough, such as a bolt, clip, or the like to secure the projections 132 to the hub 140. In addition to a bolt-type coupling, each outwardly extending projection 132 can be attached to an adjacent projection by a variety of other couplings such as threaded connections, interference fits, and a spring-loaded coupling, among others. The hub 140 can alternatively define internal or external threads thereon to threadably receive each projection 132. By way of further example, the hub can include spring loaded retainers that have a button that may be depressed to permit each projection to be slid thereover, and permit the spring-loaded button to engage an opening 148 in the projection 132, as desired.

The hub 140 effectively sets the relative angles of the protrusions or legs 132 of the frame 130, and thus the overall device 100. The modularity provided by the disclosed implementations facilitates disassembly of the device 100 for storage and shipment. Moreover, in case of damage, the modular design of the device 100 permits any damaged leg to be replaced with a new component. Moreover, the modular nature of the design permits different sized protrusions or legs 132 to be attached to a given hub, facilitating manufacturing. The hub 140 can be made from a heavy material, such as steel pipe, and its mass can serve as a center of gravity for the device 100. By way of further example, the tubular sections of the hub 140 can be replaced by a flexible element such as flexible heavy metallic coils (e.g., coil 160, FIGS. 8A, 8B, provided for purposes of illustration only) that receive the protrusions 132 over or within the coils, permitting each protrusion 132 to move and flex with respect to the other protrusions 132. By way of further example, heavy coils can be fit inside or outside of the sleeves 142 and protrusions 132 to provide a flexible coupling.

Figure 12:
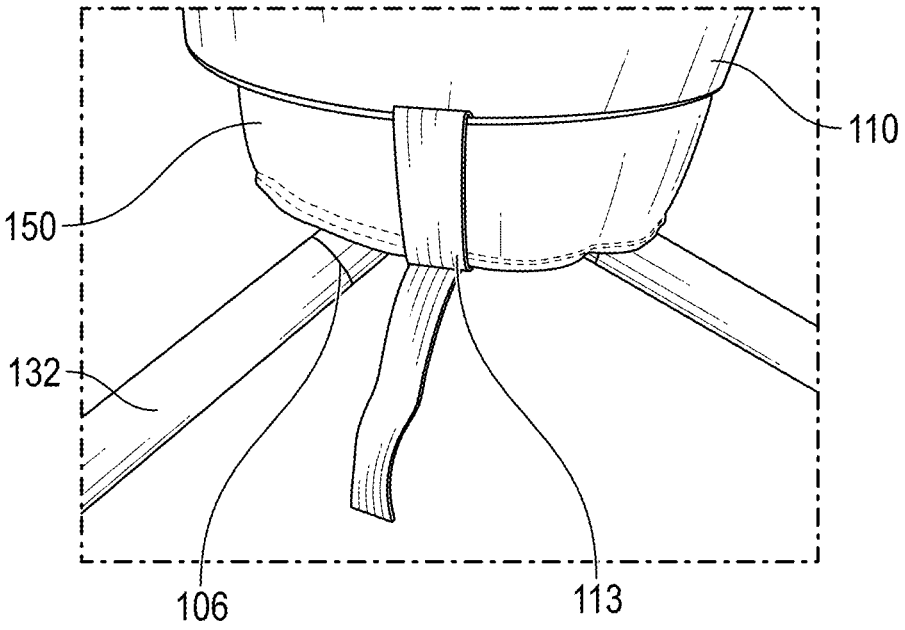
FIG. 12 is an enlarged isometric view of an implementation of a pad having a reduced profile section proximate the frame in accordance with the present disclosure.
Figure 13B:
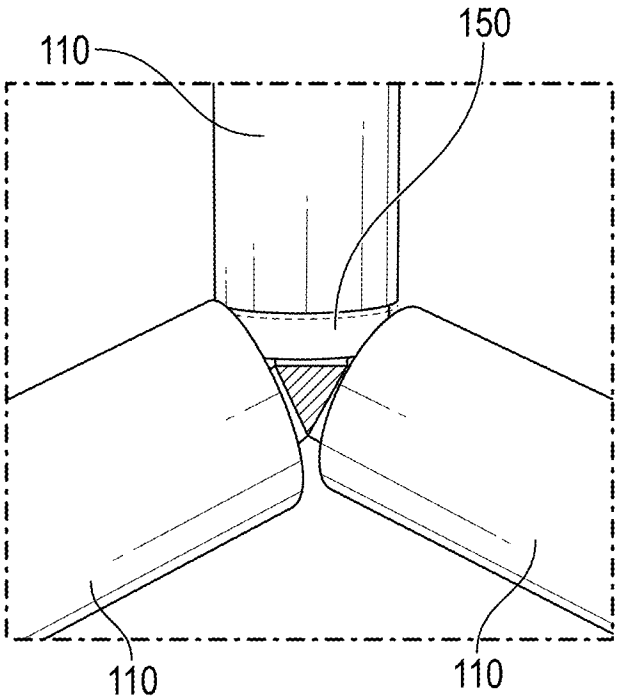
FIG. 13B is an enlarged view of a central portion of the device of FIG. 13A.
Figure 13A:
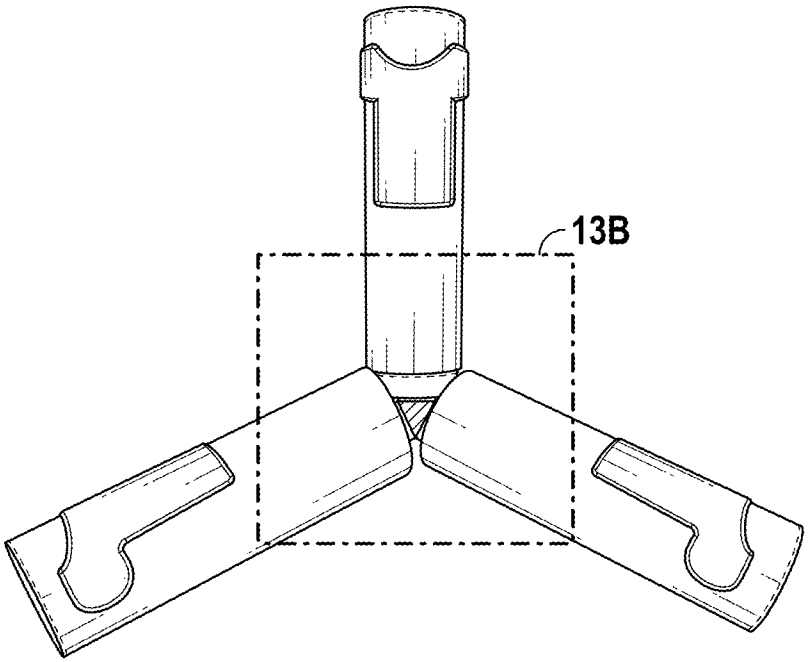
FIG. 13A is a front view of a tackling training device in accordance with the present disclosure having at least one pad having a reduced profile section proximate the frame in accordance with the present disclosure.
Figure 14:
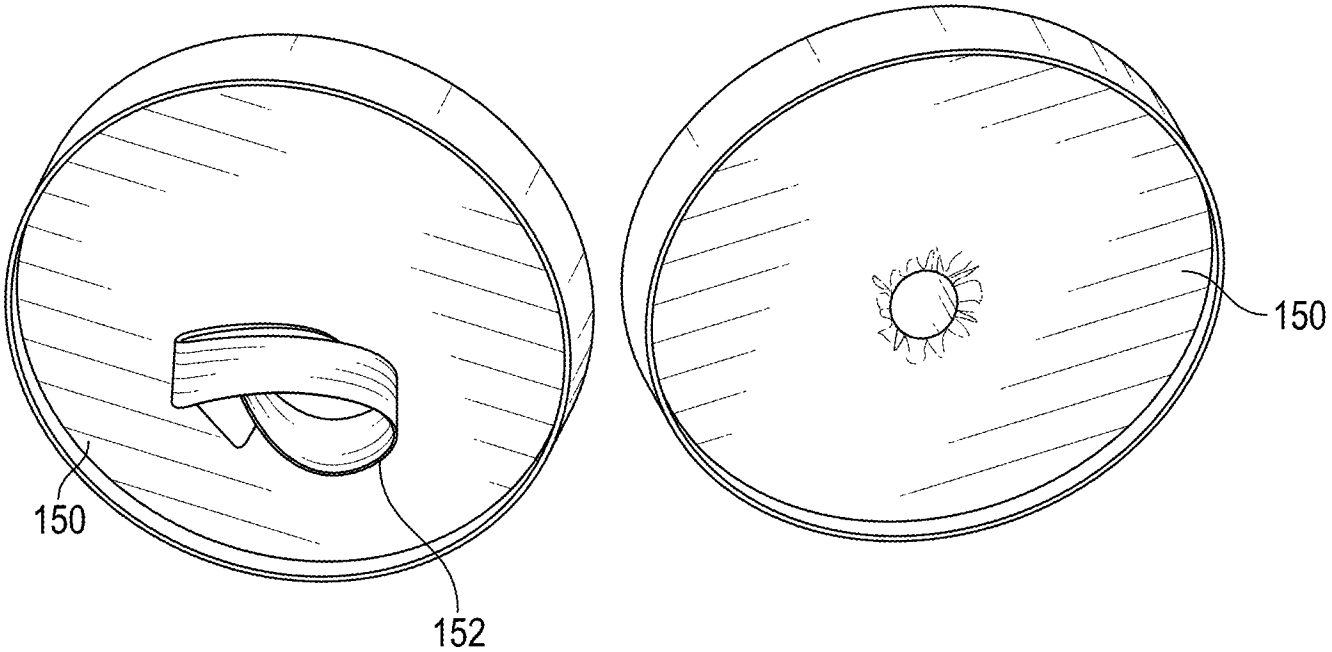
FIG. 14 is a top isometric view of a pair of spacers that can be used for the tackling training device in accordance with the present disclosure.

FIG. 14 depicts two toroidal, or ring-shaped pads 150 that can be used to close up the gap between the pads 110 where they meet at the center of the device 100 and to cushion a user from a direct impact with the hub. While the ring-shaped pads 150 can be discrete components, they can similarly be integrated into one or more of the pads 110. For example, FIG. 12 illustrates relative placement of a pad 110 with a pad 150 for the upper or vertical leg of the device 100 (as depicted) that is parallel to the main shaft of the hub 140. These pads 150 can be integral or separate from pads 110. If separate from pad 110, each pad 150 can include its own strap 113 and buckle 115, or the pad 150 may be held in place by the strap 113 of pad 110. A second ring-shaped pad 150 can be provided with a buckle that independently holds a pad 150 to an underside of the hub 140, as discussed in further detail below. Thus, if desired, at least one of the pads 110 can, if desired, be provided with a section of reduced diameter proximate the hub to help fill the gap between the respective pads 110 either as an extension of the pad 110 or as a separate component as illustrated in the figures.

Figure 16:
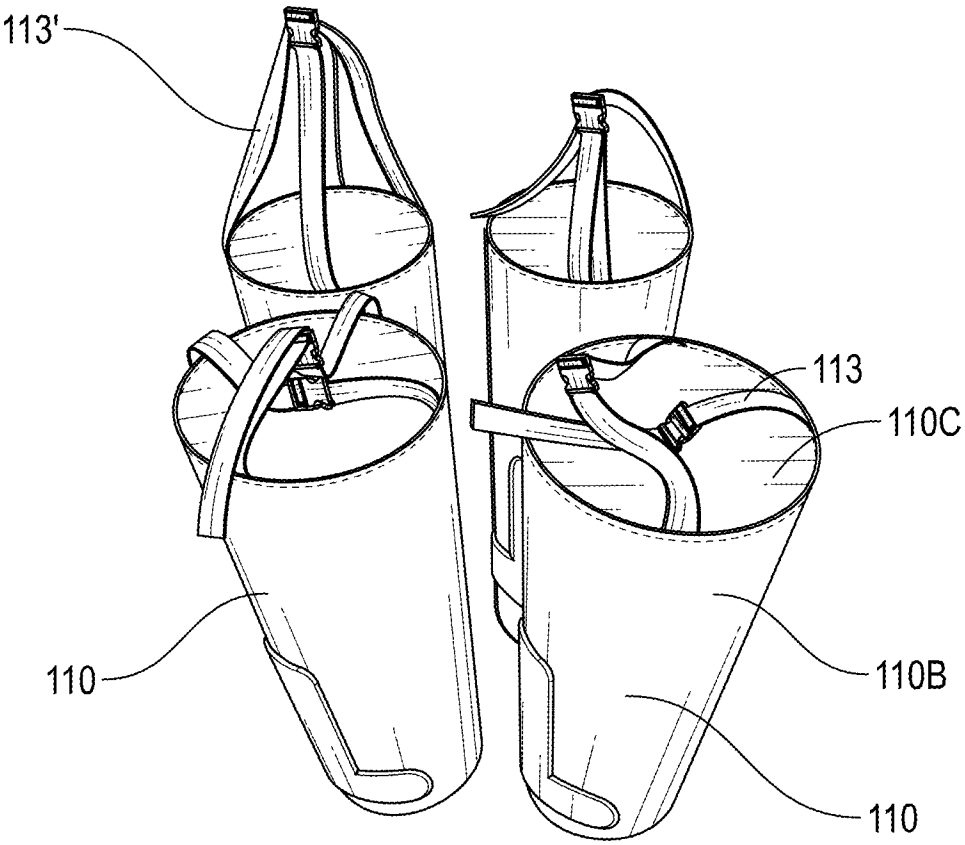
FIG. 16 is a view of a plurality of pads that may be used in combination with the components of FIG. 15 and FIG. 14 to assemble a tackling training device in accordance with the present disclosure.

As further illustrated in the figures, each padded portion 110 can be removably coupled to the frame 130 by one or more couplings such as straps 113. With reference to FIG. 16, a set of straps 113' can be longer than the sets of straps of other pads 110 to facilitate assembly as described below. The straps 113 can be stitched to the inward ends of the fabric covering (110B, 117A, 117C) of each pad 110 and be coupled to each other by a buckle 115 or other suitable coupling. Each pad 110 includes a flexible interior body of a padding or dunnage material 110A, such as foam. The foam inner body 110A includes a passageway along at least a part of its length to receive a respective protrusion 132 of the frame 130 and an associated resilient end cap 134. With reference to FIGS.> 7A-7B, the outer fabric layer covering the foam material (e.g., 110B) can be provided with an end cap 118 stitched to material surrounding the periphery of the foam material 110B. As depicted the end can define a concavity surrounded by a peripheral wall 118A. Alternatively, the end cap can be flat as with the implementation of FIGS. 14-28.

Figure 11:
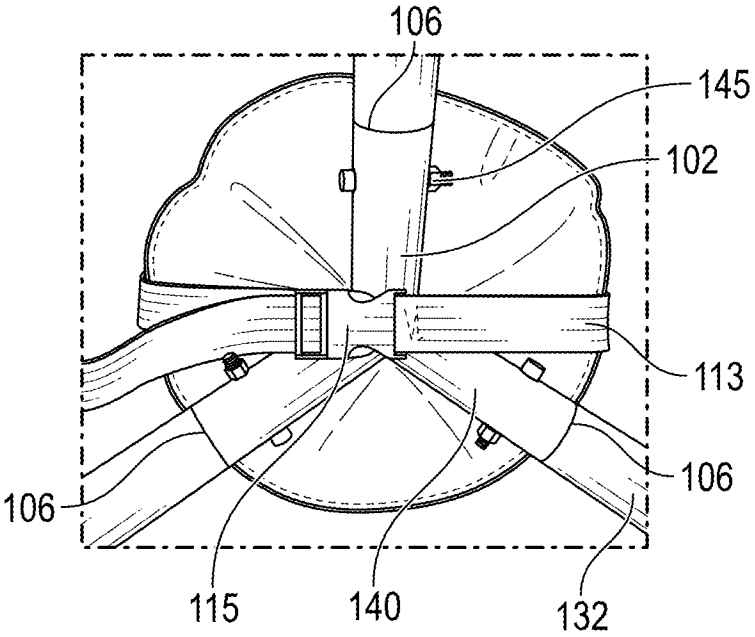
FIG. 11 is a bottom view of the assembly of FIG. 10 specifically illustrating an attachment technique used to attach the padded section to the frame.
Figure 10:
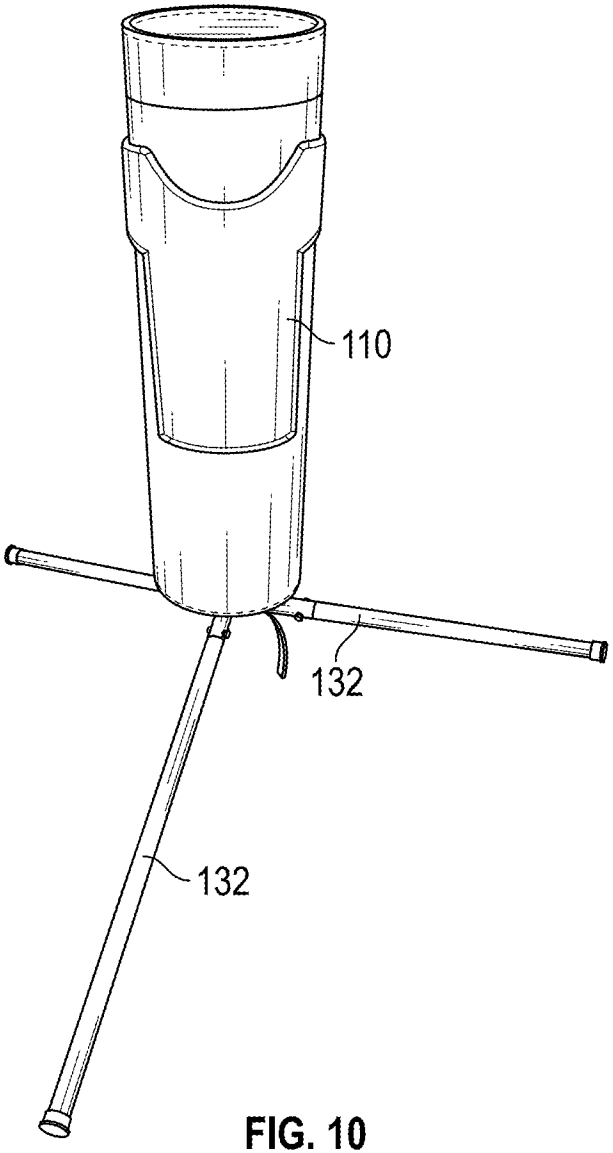
FIG. 10 is an upper isometric view of a frame as depicted in FIG. 8A with a single padded section attached to the frame.

As depicted in FIG. 11, coupling 113, 115 can be configured to removably attach each pad 110 to the frame 130 by routing the strap 113 over the frame 130 and coupling each respective buckle 115. The strap 113 can then be tightened by pulling it through the buckle 115 to hold the pad 110 in place on the frame 130. In addition to a buckle and strap arrangement, the coupling to hold the pad 110 to the frame 130 can similarly include straps with hook and loop fasteners, adhesive materials, threaded fasteners, clips, elastic bands, and/or the like. The frame 130 and hub 140 are preferably made from a rigid material such as a metallic material or composite material and assembled as described herein. Alternatively, the frame can be made from a resilient material that can collapse for storage and shipment.

Each pad 110 can have a cross sectional shape selected from a circle, an ellipse, and a polygon, for example. In some implementations, one or more of each of the pads 110 can be provided with at least one raised surface extending above the external contour of the pad. For purposes of illustration, and not limitation, as depicted in various figures, each pad 110 can include a raised surface 120 formed onto each pad 110 that can form a visual target that can be gripped by a player that is practicing a tackling drill. As depicted, the raised surface 120 has a shape resembling a portion of an opposing player, in this case, a torso 122 with a neckline 124 and shoulders 126 that wrap at least part way around the circumference of the pad 110. The raised surface can have any desired shape, such as a different anatomical region of a player such as a waist, a leg, or an arm. Alternatively, the raised surface can be shaped to resemble a portion of a football, or another suitable shape for gripping such as a fin, a boss, or the like.

Figure 22:
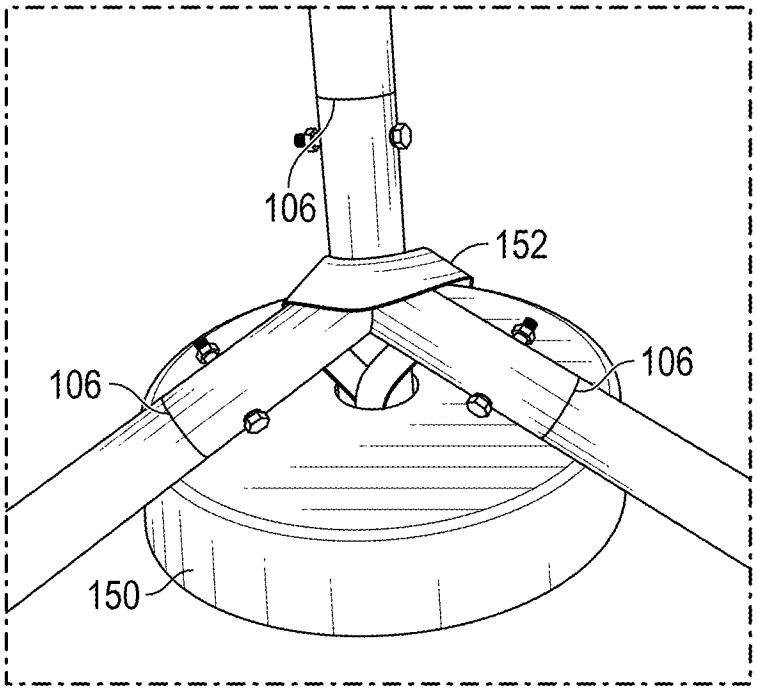
FIGS. 21-27 depict steps in the further assembly of a tackling training device in accordance with the present disclosure.

As depicted in the Figures, the disclosure provides implementations of a tackling training device that includes a frame 130 and a plurality of pads. The frame 130 includes four outwardly extending projections 132 coupled to a central hub 140. The four outwardly extending projections 132 are configured in a tetrahedral arrangement, wherein a free end 104 (see FIG. 20) of each said outwardly extending projection 132 defines an apex of a tetrahedron in three-dimensional space. The central hub 140 includes four outwardly extending sleeves 142. Each outwardly extending sleeve 142 of the central hub 140 includes an inner sleeve end 102 (see FIG. 9) joined to at least one adjacent inner sleeve end 102, and an outer sleeve end 105 (see FIG. 9) opposite the inner sleeve end 102. Each outer sleeve end 105 is joined to a respective one of the four outwardly extending projections at a respective joint 106 (see FIG. 9). As can be seen in the figures, the surface across each respective joint 106 can be smooth and continuous to permit a pad 110 to be slid over and past the joint 106 without substantial mechanical interference. Each of the pads 110 is coupled to and surrounds the free end 104 and at least a majority of a length of each respective outwardly extending projection 132. At least one of the pads 110 spans both sides of at least one of the respective joints 106 joining one of the outwardly extending sleeves 142 to one of the outwardly extending projections 132, as depicted in FIG. 22, for example, wherein the joint is covered by the pad 110. Each pad 110 is configured to absorb impact along a direction of the respective outwardly extending projection 132 on which each said pad 110 is disposed. The device further includes at least one coupling 113 to removably secure each pad 110 in the plurality of pads 110 to each of said outwardly extending projections 132. The at least one coupling 113 can include a strap 113 attached to each of the plurality of pads at a plurality of locations proximate an inner end 109 (see FIG. 1) of each of said pads 110. The strap 113 can be wrapped around and fastened to the central hub 140 of the frame 130 to permit each of said pads 110 to be held in place against the frame 130 by way of applied tension to the strap 113. Each said pad 110 can include an external contour located between an inner end 109 of the pad and an outer end 111 (see FIG. 1) of the pad 110 having at least one raised surface extending from the external contour forming a gripping surface to be gripped by a user.

Figure 15:
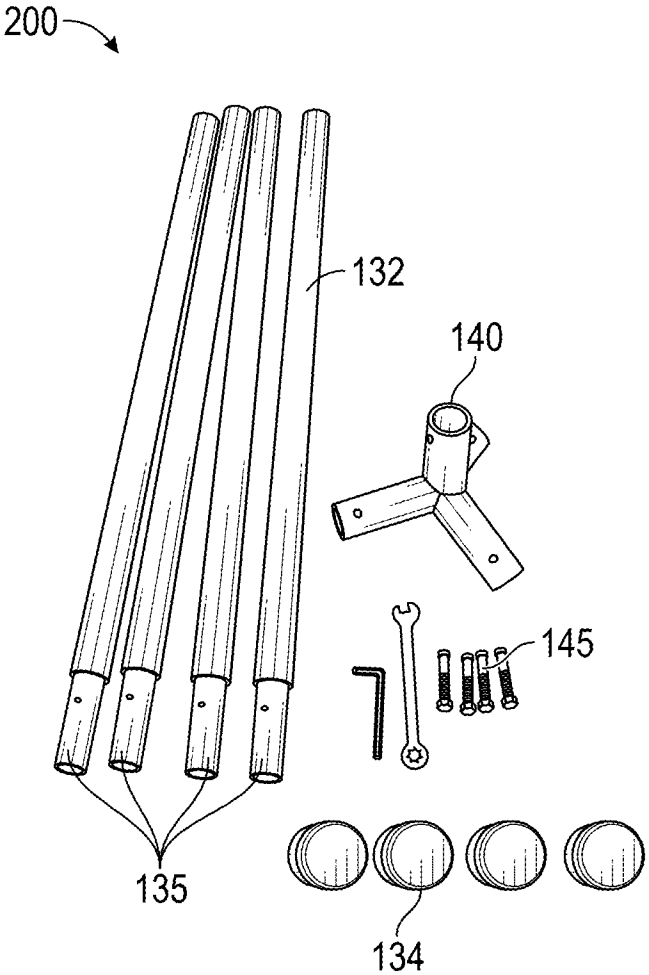
FIG. 15 is a view of a first portion of a kit that can be used for assembling a frame of a tackling training device in accordance with the present disclosure.
Figure 17:
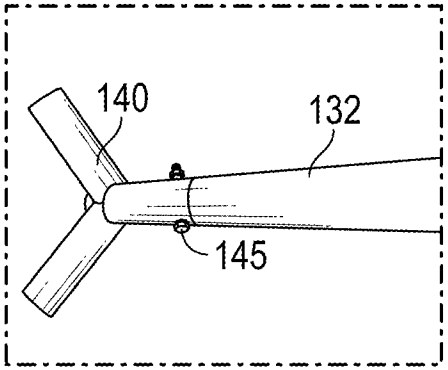
FIGS. 17-20 depict steps in the assembly of a frame of a tackling training device in accordance with the present disclosure.
Figure 18:
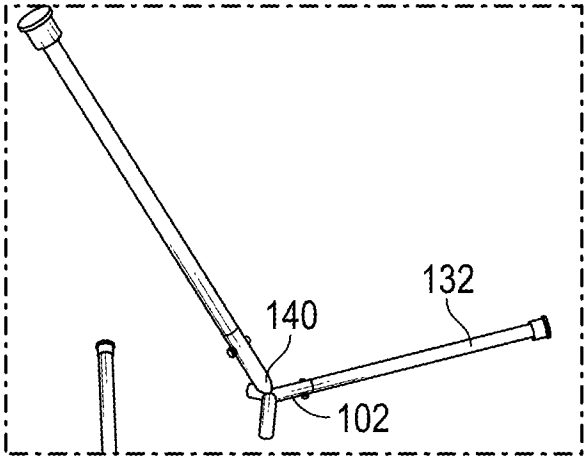
Figure 19:
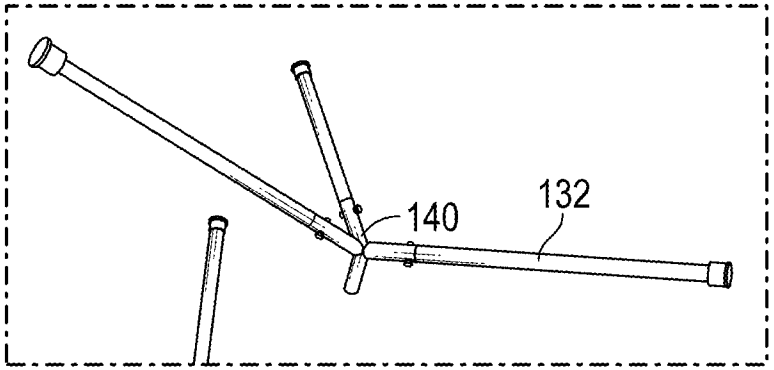
Figure 20:
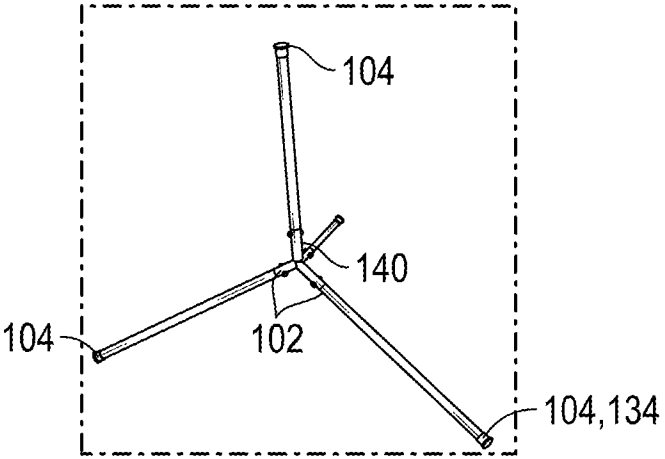

For purposes of illustration, and not limitation, as depicted in FIGS. 14-28, tackling training devices in accordance with the present disclosure can be placed into a disassembled state to facilitate storage and shipment. For example, in accordance with the disclosure, a representative method includes providing the components of the device 100 in a disassembled state, disposing the components of the device into a container 200, and shipping the container. The device can thus be provided in the form of a kit that can be assembled, as illustrated in FIGS. 15-16. The kit may include the plurality of outwardly extending projections 132, hub 140, and pads 110, 150 in a container 200. Moreover, such a kit can include sets of protrusions 132 and corresponding pads 110 of different lengths to create devices 100 of different sizes and weights.

Illustrative methods of assembling a tackling training device 100 are provided in accordance with the disclosure an as illustrated in FIGS. 15-27 that include, for example, opening the container or containers 200, coupling the plurality of outwardly extending projections 132 to the hub 140 to form the frame 130 as depicted in FIGS. 17-20, and attaching the plurality of pads 150, 110 to the frame 130 as illustrated in 21-27.

Figure 24:
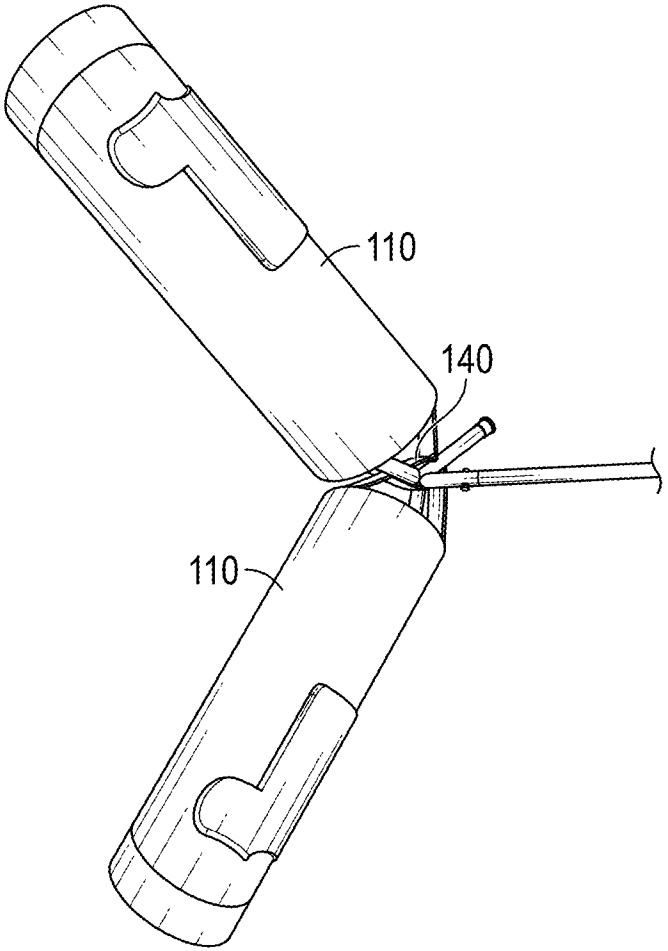
Figure 23:
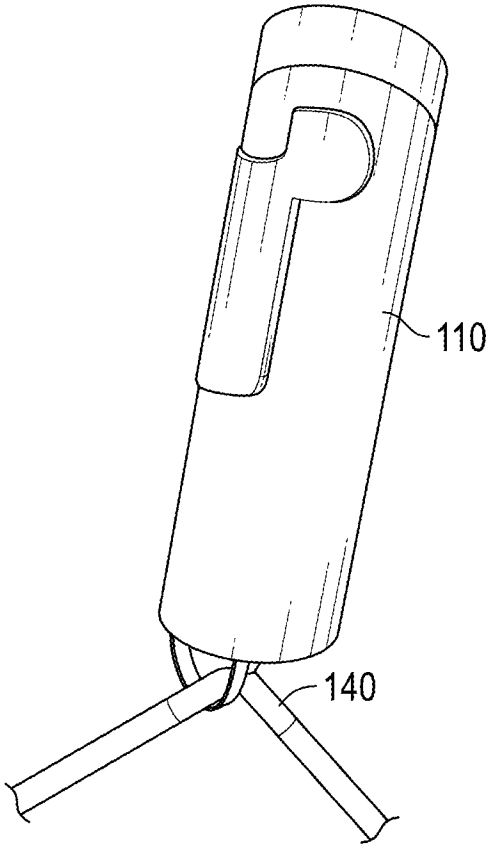
Figure 25:
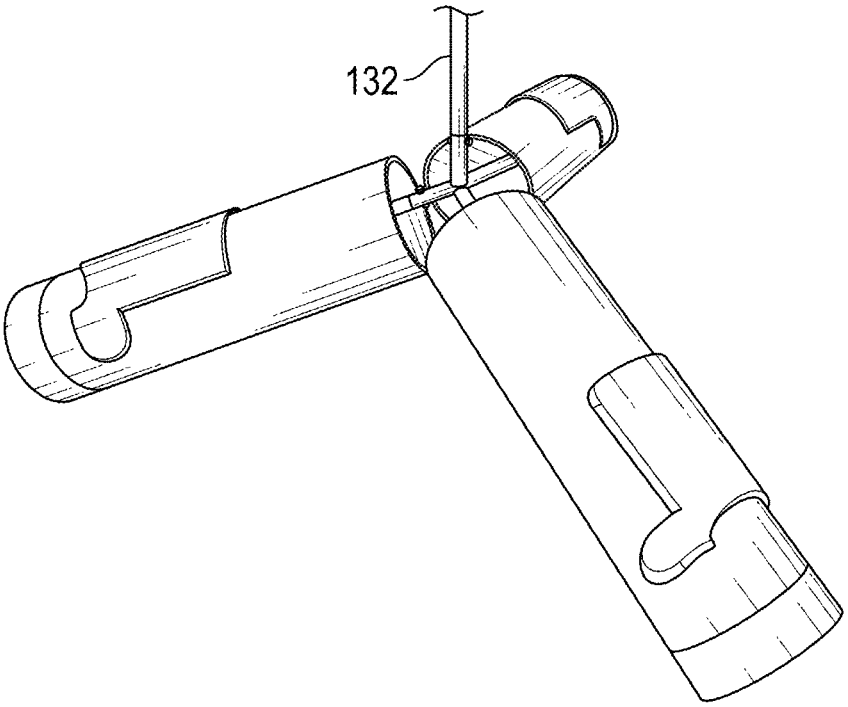
Figure 26:
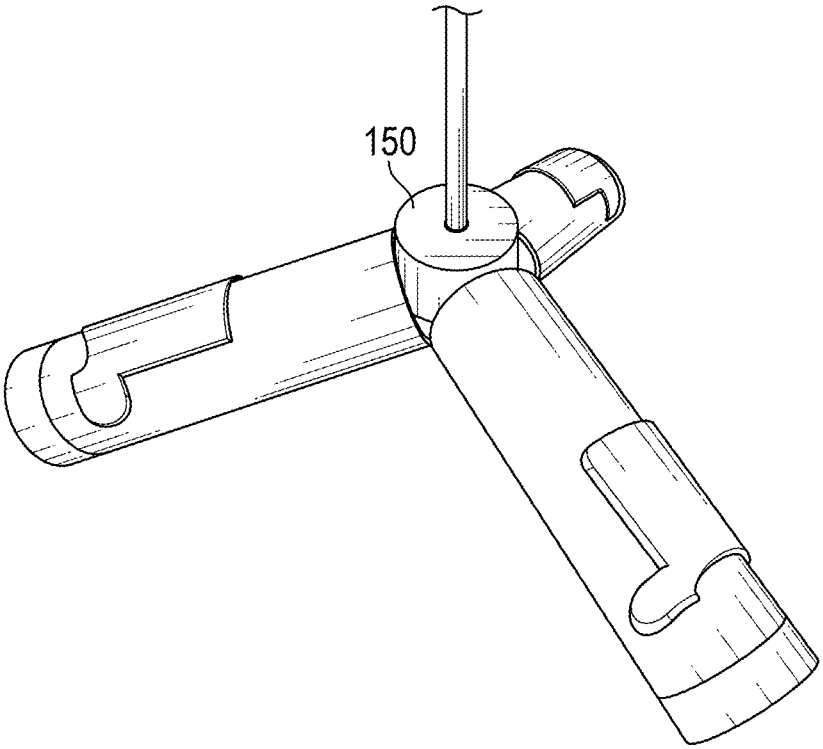

In some implementations, pads 150 can be provided with attachment straps 152 attached thereto to help cushion the hub 140 from direct physical contact with a player that tackles the device 100. This can be accomplished, for example, by first attaching a toroidal-shaped or other shaped pad across a bottom of the hub 140 to cover an opening 147 (FIGS. 21-22) defined by a lower end of the main tube portion of the hub to which the three sleeve sections 142 are welded. The elongate pads 110 may then be attached to the frame 130 by sliding each pad 100 over an respective outwardly extending projection 132 and coupling each respective pad 110 to the frame 130 using a fastener, in this illustration an adjustable strap 113 with a buckle 115. After coupling the buckle 115, the strap 113 is pulled against the frame to hold the pad 110 securely in place. FIG. 23 shows securement of a first pad 110 to a first base leg portion or protrusion 132, FIG. 24 shows attachment of a second pad 110 to a second base portion 132, and FIG. 25 shows attachment of a pad 110 to a third base protrusion 132. These three base protrusions 132 are concentrically arranged about the central tube of the hub 140. A spacer pad 150 is then slid over the remaining protrusion 130 and buckled in place, followed by placement of a further and final pad 110, which is held in place with straps 113' that can be longer than the straps that hold the other pads 110 in place.

Figure 27:
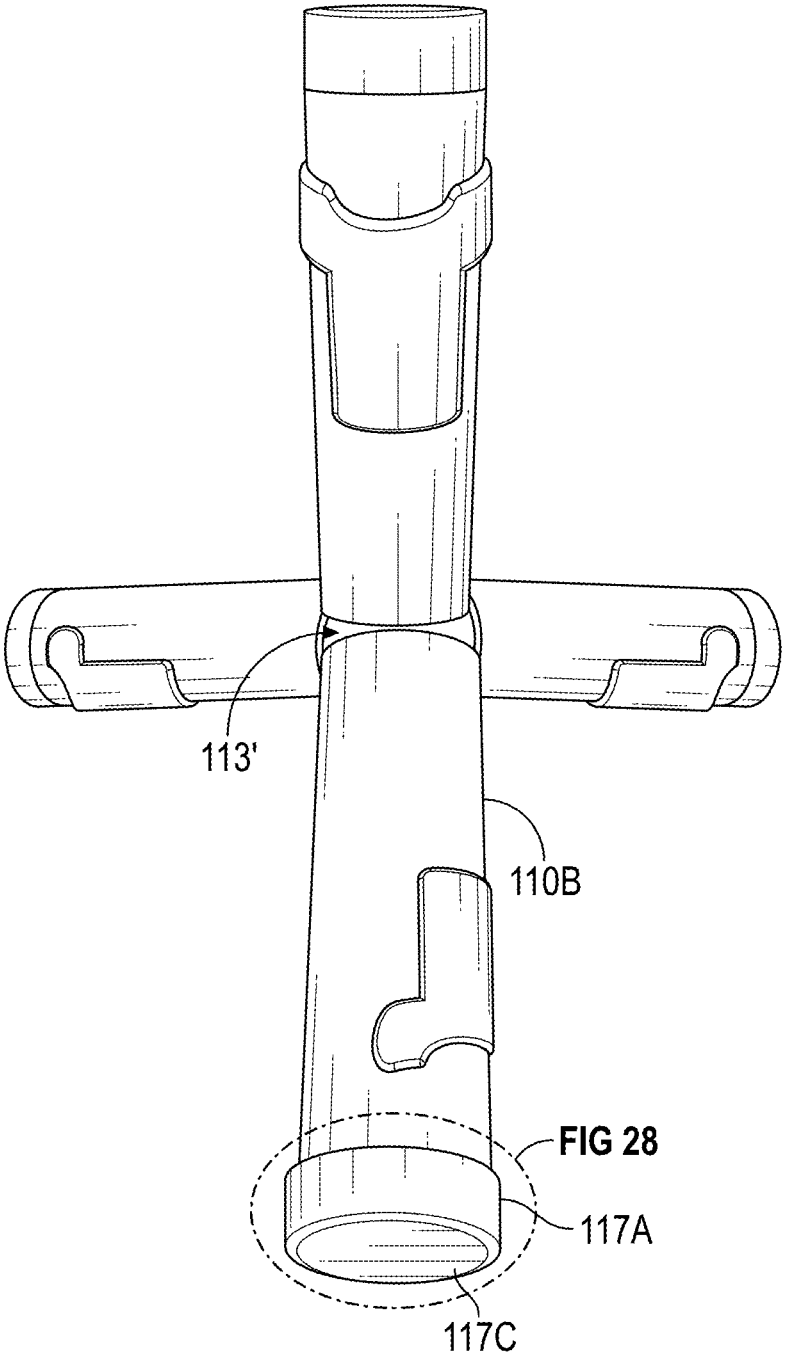
Figure 28:
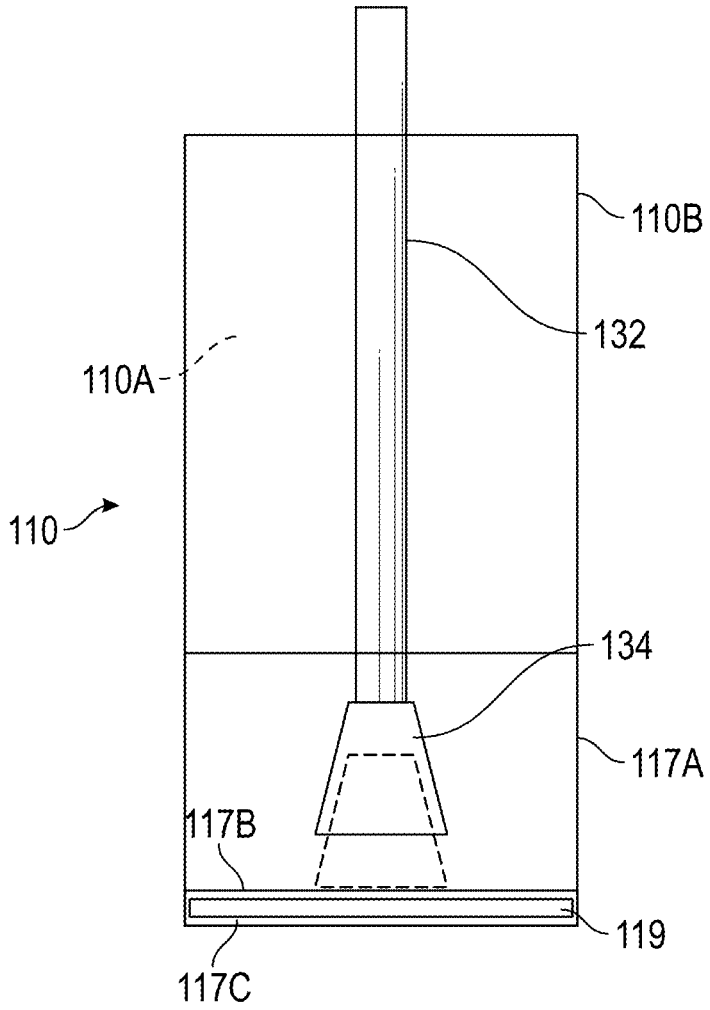
FIG. 28 depicts a cross-sectional schematic of an end of a padded section of the device of FIG. 1.

FIG. 28 depicts a cross sectional schematic of an arm section of device 100 (including a pad 110 and corresponding protrusion 132) showing illustrative relative placement of different components. FIG. 28 is presented with respect to the implementation of the device illustrated in FIG. 27. The device of FIG. 27 differs slightly from the implementation of FIG. 1 in that the device of FIG. 27 and FIG. 28 includes a modified end structure of the arm section. As illustrated in FIG. 27, the end of each arm section terminates in a cap formed from a circumferential section 117A of relatively heavy vinyl coated polyester fabric (e.g., 22 oz/sq. yd.) and an inner layer 117B and an outer layer 117C at the end surface of the arm of the device. The padded section 110 includes a foam core 110A surrounded by a fabric layer 110B with a passageway defined at least partially therethrough along a centerline thereof for receiving protrusion 132 with an endcap 134 thereon. A toroidal fabric surface 110C can be provided at the inward end of the padded section (FIG. 16). The fabric covering 110B is attached to layer 117B for example, by stitching. A layer of resilient material 119 can be disposed between layers 117B and 117C, wherein layer 117B rests against the foam interior 110A. The resilient material can include a plastic material, such as PVC to prevent the end of the protrusion 132 and/or endcap 134 from migrating against the outer end fabric of the pad 110. The layer 119 can be stitched an/or adhered to layers 117B, 117C to form a unitary structural unit. The arm and endcap 134 can terminate inside the volume of the foam. The passageway defined through the foam 110A need not run the entire length of the foam body. Alternatively, the passageway can run through the foam body to the end, and the endcap 134 can rest against the reinforced end structure of the fabric covering. The fabric covering is formed and the foam 110A is slid inside, and the inner endcap 110C can be stitched in place, holding the foam core 110A within a fabric envelope. Straps 113 can be stitched to the outer fabric 110B along any desired length of fabric layer 110B to provide sufficient anchoring for the strap 113.

The disclosure further provides implementations of performing a tackling drill including providing a device as described herein and running and tackling the device by gripping at least one of the pads and pushing the device forward. In some implementations, the gripping step can include gripping a raised surface extending outwardly from an external contour of one of the pads.

The device 100 can be provided in a variety of sizes and weights depending on the size of the players. In some implementations, the overall height can be between about 40 and about 60 inches, or any increment therebetween of about one inch. The pads 110 can have a length between 24 and 40 inches, or any increment therebetween of one inch. The device 100 can have an overall weight between about 20 and about 40 pounds, for example, or any increment therebetween of about one pound. It will be appreciated that the above-referenced dimensions are meant to only be illustrative and non-limiting.

The foam used to make the ring preferably is a polyurethane foam having a density (in lbs./ft$^3$) according to ASTM D3574-05, between about 1.0 and 1.4 lbs./ft$^3$, more preferably between about 1.2 and 1.6 lbs./ft$^3$, or any value or subrange in said ranges in increments of 0.01 lbs./ft$^3$. The foam preferably has a 25% Indentation Force Deflection (in lbs.) according to ASTM D3574-05 between about 60 and 100 lbs., more preferably between 75 and 90 lbs., or any value or subrange in said ranges in increments of 1.0 lbs. The foam preferably has a minimum tensile strength (in lbs./in$^2$) according to ASTM D3574-05 between about 10 and 25 lbs./in$^2$, such as 18 lbs./in$^2$. The foam preferably has a minimum percent elongation (%) according to ASTM D3574-05 between about 125 and 175%, such as 150%. The foam preferably has a compression set @ 90% (max) according to ASTM D3574-05 between about 7 and 15, such as 10, 11, or 12. The foam preferably has a resiliency % (min) according to ASTM D3574-05 between about 32 and about 38, such as about 33, 34, 35 or 36.

The methods and systems of the disclosed embodiments, as described above and shown in the drawings, provide for equipment and related techniques with superior attributes. It will be apparent to those skilled in the art that various modifications and variations can be made in the devices and methods of the disclosed embodiments without departing from the spirit or scope of the disclosure. Thus, it is intended that the disclosure include modifications and variations that are within the scope of the appended claims and their equivalents.

What is claimed is:

1. A tackling training device comprising:

a frame including four outwardly extending projections coupled to a central hub, the four outwardly extending projections being configured in a tetrahedral arrangement, wherein a free end of each said outwardly extending projection defines an apex of a tetrahedron in three-dimensional space, wherein:

the central hub includes four outwardly extending sleeves, each said outwardly extending sleeve of said central hub including an inner sleeve end joined to at least one adjacent inner sleeve end, and an outer sleeve end opposite the inner sleeve end, each outer sleeve end being joined to a respective one of the four outwardly extending projections at a respective joint, and the surface across each respective joint is smooth and continuous to permit a pad to be slid over and past the joint without substantial mechanical interference;

a plurality of pads, each said pad of the plurality of pads being coupled to and surrounding the free end and at least a majority of a length of each respective outwardly extending projection, at least one of said pads in the plurality of pads spanning both sides of at least one of the respective joints joining one of the outwardly extending sleeves to one of the outwardly extending projections, and each said pad of the plurality of pads being configured to absorb impact along a direction of the respective outwardly extending projection on which each said pad is disposed; and at least one coupling to removably secure each said pad in the plurality of pads to each of said outwardly extending projections, the at least one coupling including a strap attached to each of the plurality of pads at a plurality of locations proximate an inner end of each of said pads, the strap being wrapped around and fastened to the central hub of the frame to permit each of said pads to be held in place against the frame by way of applied tension to the strap.

2. The tackling training device of claim 1, wherein the central hub is removably attached to each of the four outwardly extending projections.

3. The tackling training device of claim 2, wherein each said outwardly extending projection is removably attached to the central hub in a physically overlapping relationship.

4. The tackling training device of claim 3, wherein each said outwardly extending projection is removably attached to the central hub by a fastener oriented transversely with respect to an axis defined by each respective outwardly extending projection.

5. The tackling training device of claim 2 in a disassembled state inside of a container to facilitate storage and shipment.

6. A method of providing a tackling training device according to claim 5, comprising disposing the plurality of outwardly extending projections, central hub and plurality of pads in a container, and shipping the container.

7. A method of assembling a tackling training device according to claim 5, comprising opening the container, coupling the plurality of outwardly extending projections to the central hub to form the frame, and attaching the plurality of pads to the frame after the coupling step.

8. The method of claim 7, wherein attaching the plurality of pads to the frame includes sliding each pad in the plurality of pads over a respective outwardly extending projection and coupling each respective pad to the frame using the strap.

9. The tackling training device of claim 1, wherein each said pad of the plurality of pads is formed from a padding material surrounded by a fabric layer, wherein the fabric layer fully covers the free end of each of the outwardly extending projections.

10. The tackling training device of claim 9, further comprising a resilient layer of material in direct contact with and disposed about the free end of each of said outwardly extending projections, said resilient layer of material being disposed between the fabric layer and the free end of each of said outwardly extending projections.

11. The tackling training device of claim 10, further comprising a planar disc of resilient material disposed between resilient later of material and the fabric layer.

12. The tackling training device of claim 11, wherein said resilient layer of material is formed into a shape having an enlarged lateral dimension compared to the outwardly extending projection on which it is disposed.

13. The tackling training device of claim 12 wherein the resilient layer of material includes an end cap formed from resilient material.

14. The tackling training device of claim 13 wherein each end cap is configured to absorb mechanical shock transmitted through the planar disc of resilient material.

15. The tackling training device of claim 1, wherein each said pad of the plurality of pads includes an external contour located between an inner of the pad and an outer end of the pad having at least one raised surface extending from the external contour forming a gripping surface to be gripped by a user.

16. The tackling training device of claim 15, wherein the at least one raised surface has a shape resembling a portion of an opposing player.

17. The tackling training device of claim 15, wherein the at least one raised surface includes a visual indicia distinct from the at least one raised surface to provide a visual target for a user of the device to aim for when practicing a tackle, and further wherein the visual indicia is located radially inwardly from an outer end of the pad on which it is mounted.

18. A method of performing a tackling drill including providing a device according to claim 1 and running and tackling the device by gripping at least one of the pads and pushing the device forward, wherein the gripping step includes gripping a raised surface extending outwardly from an external contour of one of the pads.

* * * * *